US007945411B2

(12) United States Patent
Kernan et al.

(10) Patent No.: US 7,945,411 B2
(45) Date of Patent: May 17, 2011

(54) METHOD FOR DETERMINING PUMP FLOW WITHOUT THE USE OF TRADITIONAL SENSORS

(75) Inventors: Daniel J. Kernan, Liverpool, NY (US); Eugene P. Sabini, Skaneateles, NY (US); Nicolas W. Ganzon, Seneca Falls, NY (US); Anthony E. Stavale, Victor, NY (US)

(73) Assignee: ITT Manufacturing Enterprises, Inc, Wilmington, DE (US)

( * ) Notice: Subject to any disclaimer, the term of this patent is extended or adjusted under 35 U.S.C. 154(b) by 1191 days.

(21) Appl. No.: 11/636,355

(22) Filed: Dec. 8, 2006

(65) Prior Publication Data

US 2007/0212210 A1 Sep. 13, 2007

Related U.S. Application Data

(60) Provisional application No. 60/780,546, filed on Mar. 8, 2006.

(51) Int. Cl.

| | |
|---|---|
| ***G01F 25/00*** | (2006.01) |
| ***G01F 9/00*** | (2006.01) |
| ***G06F 19/00*** | (2006.01) |
| ***G06F 17/40*** | (2006.01) |
| ***G05B 99/00*** | (2006.01) |

(52) U.S. Cl. ..... 702/100; 73/1.16; 702/45; 702/85; 702/187; 702/189

(58) Field of Classification Search ..... 73/1.01, 73/1.16, 1.34, 861; 137/551, 561 R, 565.11; 318/432, 433; 417/1, 14; 702/1, 33, 45, 702/50, 85, 86, 87, 88, 100, 127, 182, 189
See application file for complete search history.

(56) References Cited

U.S. PATENT DOCUMENTS 4,108,574 A 8/1978 Bartley et al.
(Continued)

FOREIGN PATENT DOCUMENTS

DE 19618462 11/1997
(Continued)

OTHER PUBLICATIONS

Four pages, German Office Action dated May 19, 2009.

(Continued)

*Primary Examiner* — Edward R Cosimano

(57) ABSTRACT

A technique for determining pump flow without using traditional sensors features steps and modules for creating a calibrated power curve at closed valve conditions at several speeds; calculating coefficients from a normalized power curve based on a pump's power ratio; and solving a polynomial power equation for flow at the current operating point. The calibrated power curve may be created by increasing the speed of the pump from a minimum speed to a maximum speed and operating the pump with a closed discharge valve. This data is used to correct published performance for shutoff power and best efficiency point power at rated speed in order to determine the pump's power ratio. It is also used to accurately determine closed valve power at the current operating speed. The pump's power ratio is determined by the equation: $P_{ratio}=P_{shutoff\ @100\%}/P_{BEP_corr}$. The polynomial power equation may, for example, include a 3rd order polynomial equation developed using coefficients from the normalized power versus flow curve, and corrections may be made for speed, hydraulic efficiency and specific gravity in the polynomial power equation. Complex roots may be determined to solve the 3rd order polynomial equation using either Muller's method or some other suitable method, and the calculated actual flow may be determined for a specific operating point.

51 Claims, 5 Drawing Sheets

The Basic Flowchart

U.S. PATENT DOCUMENTS

| | | | | |
|---|---|---|---|---|
| 4,358,821 | A | 11/1982 | Niemi | |
| 4,990,058 | A | 2/1991 | Eslinger | |
| 5,213,477 | A | 5/1993 | Watanabe et al. | |
| 5,229,699 | A | 7/1993 | Chu et al. | |
| 5,394,322 | A | 2/1995 | Hansen | |
| 5,616,998 | A | 4/1997 | Sepehri et al. | |
| 6,424,873 | B1 | 7/2002 | Przybylski | |
| 6,464,464 | B2 | 10/2002 | Sabini et al. | |
| 6,546,295 | B1 | 4/2003 | Pyotsia et al. | |
| 6,554,198 | B1 | 4/2003 | Hull et al. | |
| 6,591,697 | B2 | 7/2003 | Henyan | |
| 6,648,606 | B2 * | 11/2003 | Sabini et al. | 417/53 |
| 6,709,241 | B2 | 3/2004 | Sabini et al. | |
| 6,715,996 | B2 | 4/2004 | Moeller | |
| 6,776,584 | B2 | 8/2004 | Sabini et al. | |
| 7,080,508 | B2 * | 7/2006 | Stavale et al. | 60/431 |
| 7,112,037 | B2 * | 9/2006 | Sabini et al. | 415/118 |
| 2003/0091443 | A1 * | 5/2003 | Sabini et al. | 417/53 |
| 2003/0129062 | A1 * | 7/2003 | Sabini et al. | 417/22 |
| 2003/0133808 | A1 * | 7/2003 | Sabini et al. | 417/53 |
| 2004/0120804 | A1 * | 6/2004 | Sabini et al. | 415/118 |
| 2004/0267395 | A1 | 12/2004 | Discenzo et al. | |
| 2005/0237021 | A1 | 10/2005 | Sugano et al. | |
| 2005/0252205 | A1 | 11/2005 | Stavale et al. | |
| 2007/0212229 | A1 * | 9/2007 | Stavale et al. | 417/42 |
| 2007/0212230 | A1 * | 9/2007 | Stavale et al. | 417/42 |

FOREIGN PATENT DOCUMENTS

| | | |
|---|---|---|
| WO | WO 2005/064167 | 7/2005 |

OTHER PUBLICATIONS

Four pages, English Translation of German Office Action dated May 19, 2009.

6 Pages Finnish Office Action dated Apr. 9, 2010.

English Language Translation 6 Pages Finnish Office Action dated Apr. 9, 2010.

Keskipakopumput, Allan Wirzenius, Kustannusyhtyama Tampere, kappaleet 7.3-7.5 sivuilla 55-61, 1969.

* cited by examiner

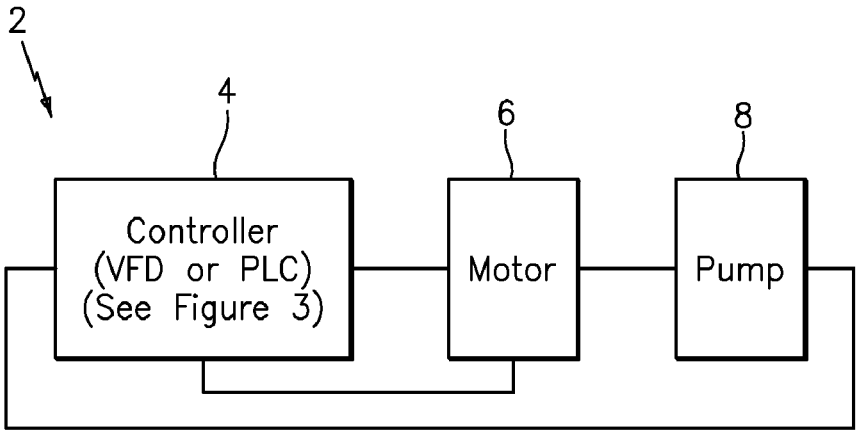
*FIG. 1* : The Basic Pump System
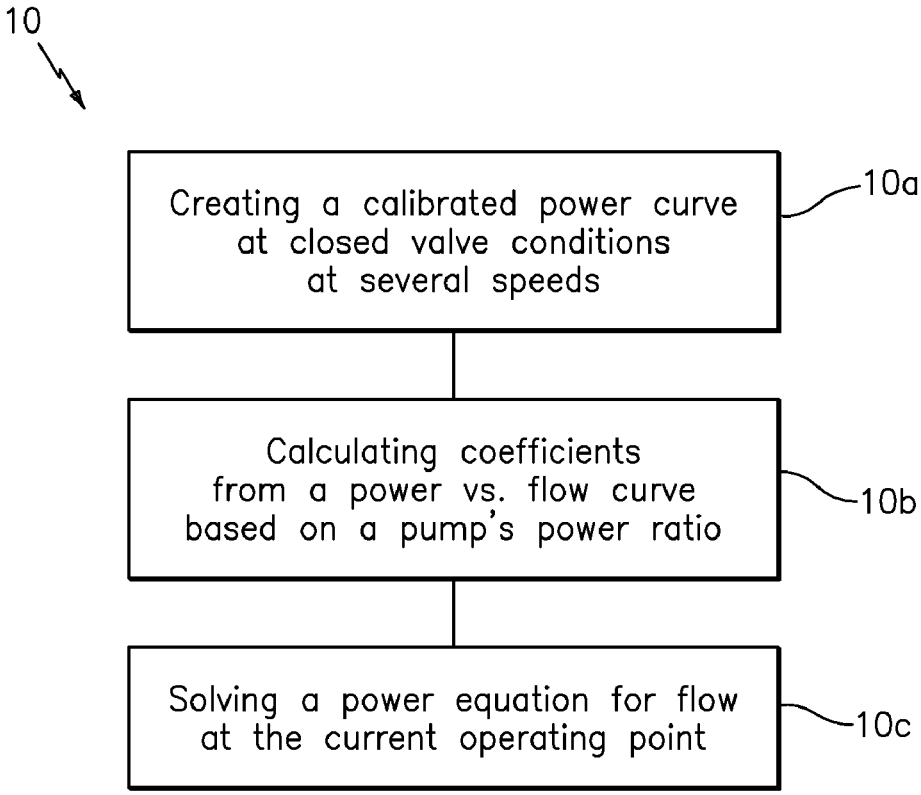
*FIG. 2* : The Basic Flowchart

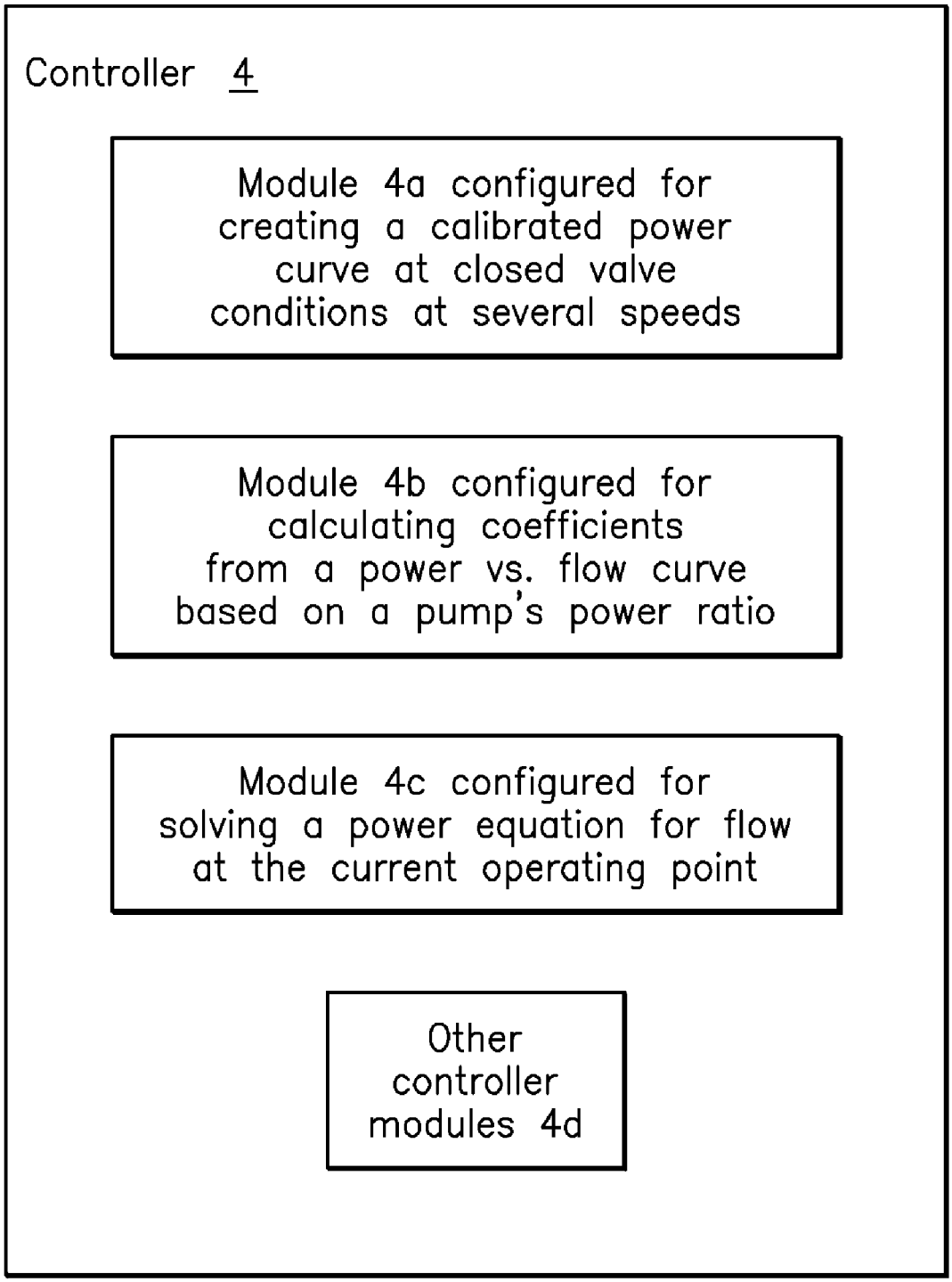
*FIG. 3* : The Controller 4

METHOD FOR DETERMINING PUMP FLOW WITHOUT THE USE OF TRADITIONAL SENSORS

CROSS-REFERENCE TO RELATED APPLICATIONS

This patent application claims benefit to expired provisional patent application Ser. No. 60/780,546, filed 8 Mar. 2006, entitled "Method for Determining Pump Flow Without the Use of Traditional Sensors," which is hereby incorporated by reference in its entirety.

The patent application is related to pending patent application Ser. No. 11/601,373, filed 17 Nov. 2006, entitled "Method and Apparatus For Pump Protection Without the Use of Traditional Sensors," and is also related to expired provisional patent application Ser. No. 60/780,547, filed 8 Mar. 2006, entitled "Method for Optimizing Valve Position and Pump Speed in a PID Control Valve System without the Use of External Sensors" that corresponds to pending patent application Ser. No. 11/704,891, filed 9 Feb. 2007, which are all hereby incorporated by reference in their entirety.

BACKGROUND OF THE INVENTION

1. Field of the Invention

The present invention relates to a pump system having a pump, including a centrifugal pump; and more particularly to a method for determining pump flow without the use of traditional sensors.

2. Brief Description of Related Art

Pumping devices known in the art, techniques associated with the same, and their shortcomings are as follows:

Controllers for pumps are known to use the Pump Affinity Laws, which are approximations of how the performance (flow, head, power) of a centrifugal pump is affected by speed and by impeller trim. While the affinity laws are effective for general estimations, the factoring coefficient for power frequently results in an over or under estimation of power based upon the operating speed, size and specific speed of the pump. This inaccuracy directly influences algorithms for pump protection and flow prediction that can be found in Programmable Logic Controllers (PLC), Distributed Control Systems (DCS), and Variable Frequency Drives (VFD).

Furthermore, when creating pump performance maps, variations in actual pump performance from standard performance curves significantly degrades the accuracy of flow and/or pump condition estimation. The most common solution to this is to perform a pump performance test at multiple speeds to confirm accurate pump performance. However, this solution can become timely, application specific and quite costly. In view of this, there is a need in the industry for a technique that overcomes the error of the affinity laws.

U.S. Pat. No. 6,715,996 B2, issued to Moeller, discloses a method for the operation of a centrifugal pump that samples the pump power at closed valve condition for two speeds, determines parasitic losses and calculates an adjusted power at other frequencies to determine if the pump is operating at closed valve condition. However, methods to correct power at closed valve condition like this begin to lose accuracy at speeds below 50% of nominal motor speed and can limit application range. The method of interpolation between power values at other speeds is based partly on the affinity laws and as such is less accurate.

PCT WO 2005/064167 A1 issued to Witzel, Rolf et al., discloses a technique that uses a calibrated power/differential pressure curve vs flow vs speed. The calibrated data is stored and compared to current values in order to determine pump flow. This technique requires a differential pressure transmitter and requires that calibration curves for power/Δ pressure vs. flow be stored in the evaluation device. This method is application specific to obtain flow thereby reducing flexibility during field setup. It is also not easily adjusted to compensate for wear.

U.S. Pat. No. 6,591,697, issued to Henyan, discloses a method for determining pump flow rates using motor torque measurements, which explains the relationship of torque and speed versus pump flow rate and the ability to regulate pump flow using a Variable Frequency Drive (VFD) to adjust centrifugal pump speed. However, this technique utilizes calibrated flow vs torque curves for several speeds which are application specific thereby reducing flexibility during field setup. It is also not easily adjusted to compensate for wear.

U.S. Pat. No. 6,464,464 B2, issued to Sabini, et al., discloses an apparatus and method for controlling a pump system based on a control and pump protection algorithm which uses a VFD to regulate flow, pressure or speed of a centrifugal pump. However, this technique requires the use of auxiliary instrumentation which adds cost and complexity to the drive system, a potential failure point, and unnecessary cost. It also utilizes calibrated Flow vs TDH curves at several speeds which are application specific thereby reducing flexibility during field setup.

Furthermore, the following patents were developed in a patentability search conducted in relation to the present invention. Below is a brief summary thereof:

U.S. Pat. No. 4,358,821 discloses a method and apparatus for the incorporation of varying flow in the control of process quantities, where the passing flow is measured and the amount of material flowed through the process is determined by integration of the results of the measurement.

U.S. Pat. No. 5,213,477 discloses an apparatus for pump delivery flow rate control, where maximum allowable flow is determined based on a relationship between the available and required net positive suction head (NPSH).

U.S. Pat. No. 6,424,873 discloses a method and system for limiting integral calculation components in a PID controller, based on a technique where an integral calculation component of a primary PID controller is excluded or a portion thereof or is included in a PID calculation.

U.S. Pat. No. 6,546,295 discloses a method of tuning a process control loop in an industrial process, where field device and process controllers are fine-tuned by determining control parameters for the controllers that interact to provide a desired process variability.

U.S. Pat. No. 6,554,198 discloses a slope predictive control and digital PID control for controlling a variable air volume (VAV) box in a pressure independent VAV temperature control system, based on a technique involving a calculation of an error between an airflow setpoint and measured airflow.

Patent Publication No. 2004/0267395 discloses a system and method for dynamic multi-objective optimization of machine selection, integration and utilization, based on a technique where asset utilization in an industrial automation system is modified based on a function of analyzed diagnostic and machine data.

Patent Publication No. 2005/0237021 discloses a rotatingly driving device of construction machinery, in the form of a method and apparatus for pumping a fluid at a constant average flow rate.

None of the aforementioned patents or publications teach or suggest the technique described herein for determining pump flow without traditional sensors.

SUMMARY OF THE INVENTION

The present invention provides a new and unique method for determining pump flow in a centrifugal pump, centrifugal mixer, centrifugal blower or centrifugal compressor without using traditional sensors, featuring steps of creating a calibrated power curve at closed valve conditions at several speeds; calculating coefficients from a power vs flow curve based on a pump's power ratio; and solving a power equation for flow at the current operating point.

The calibrated power curve may be created by increasing the speed of the pump from a minimum speed to a maximum speed while operating the pump against a closed discharge valve and collecting speed and power data at several speeds. This data is used to correct published performance for shutoff power and best efficiency point power at rated speed in order to determine the pump's power ratio. It is also used to accurately determine closed valve power at the current operating speed. This is necessary because published performance data often differs from actual data due to seal losses, wear, casting variations etc.

The pump's power ratio is calculated by the equation:

$$P_{ratio}=P_{shutoff@100\%}/P_{BEP_corr}.$$

The power equation may, for example, include a 3rd order polynomial equation developed using coefficients from a normalized power versus flow curve, and corrections may be made for speed and hydraulic efficiency in the polynomial power equation. In addition, complex roots may be determined to solve the 3rd order polynomial equation using either Muller's method or some other suitable method, and the calculated actual flow may be determined for a specific operating point.

The steps of the method may be performed on a variable frequency drive (VFD) having one or more modules that implements the features set forth herein, as well as a programmable logic controller (PLC).

The present invention may also include a controller having one or more modules configured for implementing the features set forth herein, as well as a pump system having such a controller.

BRIEF DESCRIPTION OF THE DRAWING

The drawing includes the following Figures:

FIG. 1 is a block diagram of a basic pump system according to the present invention.

FIG. 2 is a flowchart of basic steps performed according to the present invention by the controller shown in FIG. 1.

FIG. 3 is a block diagram of a controller shown in FIG. 1 for performing the basic steps shown in FIG. 2.

DETAILED DESCRIPTION OF THE INVENTION

FIG. 1 shows the basic pump system generally indicated as 2 according to the present invention, having a controller 4, a motor 6 and a pump 8. In operation, and according to the present invention, the controller 4 provides for determining pump flow without using traditional sensors based on a technique of creating a calibrated power curve at closed valve conditions at several speeds; calculating coefficients from a power vs flow curve based on a pump's power ratio; and solving a power equation for flow at the current operating point, consistent with that shown and described herein.

FIG. 2 shows, by way of example, a flowchart generally indicated as 10 having the basic steps 10*a*, 10*b*, 10*c* of the pump flow determination algorithm that may be implemented by the controller 4 according to the present invention. The determined flow value may also be used as an input to a PID control loop to control flow without an external flowmeter or traditional instrumentation. The flow determination algorithm may be embedded in a Variable Frequency Drive or Programmable Logic Controller like that shown above in relation to the controller 4 in FIG. 1.

According to the present invention, the calibrated power curve may be created by increasing the speed of the pump from a minimum speed to a maximum speed and operating the pump against a closed discharge valve. This data is used to correct published performance for shutoff power and best efficiency point power at rated speed in order to determine the pump's power ratio. It is also used to accurately determine closed valve power at the current operating speed.

The pump's power ratio may be calculated by the equation:

$$P_{ratio}=P_{shutoff@100\%}/P_{BEP_corr}.$$

The power equation may, for example, include a 3rd order polynomial equation developed using coefficients from a normalized power versus flow curve, and corrections may be made for speed and hydraulic efficiency in the polynomial power equation. In addition, complex roots may be determined to solve the 3rd order polynomial equation using either Muller's method or some other suitable method, and the calculated actual flow may be determined for a specific operating point.

Figure 4:
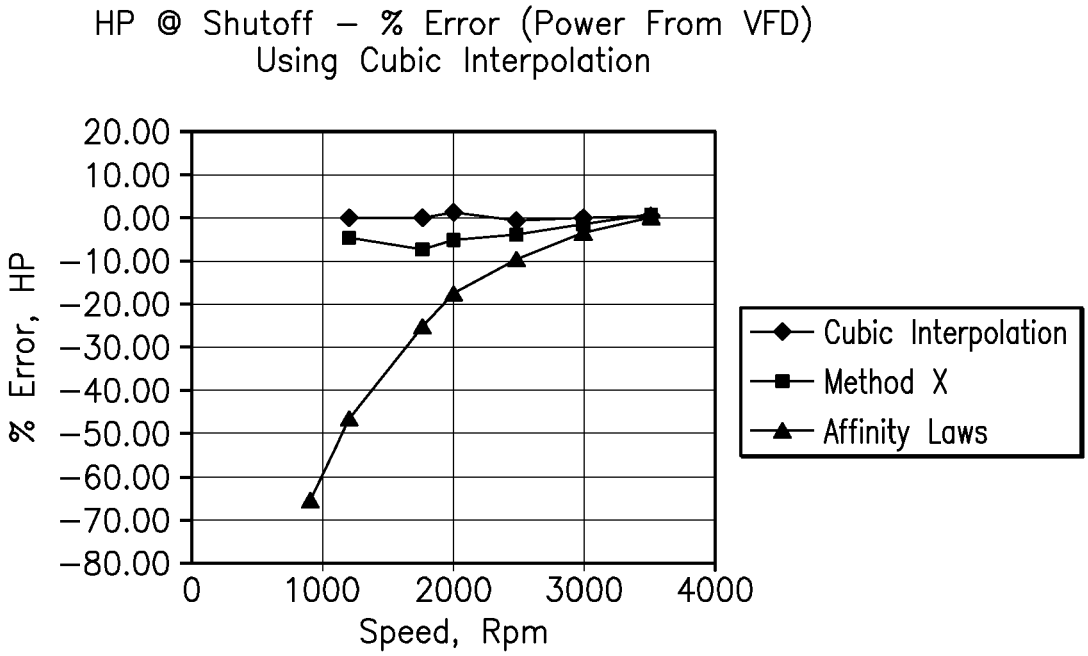
FIG. 4 is a graph of curves of % error (HP) versus speed (RPM) using various methods such as cubic interpolation, method X and affinity laws.

One advantage of the present invention is that it overcomes the error of the affinity laws by sampling power at various speeds at closed valve condition so that an accurate power curve can be generated at shut-off condition. By using a proprietary cubic interpolation method the pump power at closed valve condition can then be determined accurately over a wide speed range. See the graphs shown in FIGS. 4 and 5.

Power obtained using published pump performance curve data often differs from the actual power due to pump seal losses which vary linearly. The difference between actual and published power at shutoff condition can be used to offset (adjust) the published curve power at the pump's best efficiency point (BEP) since seal losses are constant for a given speed. This approach eliminates the need for a highly accurate pump performance curve (e.g. factory test) or a more complicated field calibration process. This process creates a more accurate estimation of $P_{BEP}$ and $P_{SO}$ at various speeds. This data can then be used for more advanced modeling of pump performance based upon minimal external data.

The method of integrating the normalized power coefficients into a $3^{rd}$ order power equation eliminates the need to perform flow calibrations against parameters such as torque, power or pressure at various speeds, eliminates the need for external transmitters and provides application flexibility during field setup. The present invention can provide for wear compensation by periodically performing the tuning described in step A below.

FIG. 3: The Controller 4

FIG. 3 shows the basic modules 4*a*, 4*b*, 4*c*, 4*d* of the controller 4. Many different types and kind of controllers and control modules for controlling pumps are known in the art. Based on an understanding of such known controllers and control modules, a person skilled in the art would be able to implement control modules such as 4*a*, 4*b*, 4*c* and configure the same to perform functionality consistent with that described herein, including creating a calibrated power curve at closed valve conditions at several speeds; calculating a normalized power curve coefficient based on a pump's power ratio; and solving a polynomial power equation for flow at the current operating point, such as that shown in FIG. 2 and described above, in accordance with the present invention. By way of example, the functionality of the modules 4*a*, 4*b*, 4*c* may be implemented using hardware, software, firmware, or a combination thereof, although the scope of the invention is not intended to be limited to any particular embodiment thereof. In a typical software implementation, such a module would be one or more microprocessor-based architectures having a microprocessor, a random access memory (RAM), a read only memory (ROM), input/output devices and control, data and address buses connecting the same. A person skilled in the art would be able to program such a microprocessor-based implementation to perform the functionality described herein without undue experimentation. The scope of the invention is not intended to be limited to any particular implementation using technology known or later developed in the future.

The controller has other controller modules 4*d* that are known in the art, that do not form part of the underlying invention, and that are not described in detail herein.

The Motor 6 and Pump 8

The motor 6 and pump 8 are known in the art and not described in detail herein. Moreover, the scope of the invention is not intended to be limited to any particular type or kind thereof that is either now known or later developed in the future. Moreover still, the scope of the invention is also intended to include using the technique according to the present invention in relation to controlling the operation of a centrifugal pump, centrifugal mixer, centrifugal blower or centrifugal compressor.

The Implementation

This method of flow calculation has two basic steps:

Step A is to create a calibrated power curve at closed valve condition at several speeds.

Step B is to calculate the normalized power curve coefficients based on a pump's power ratio and solve a $3^{rd}$ order polynomial power equation for flow at the current operating point.

Step A

The logic according to the present invention works by increasing pump speed from a predetermined minimum speed (e.g. 30% of maximum speed) to a higher level of speed (e.g. 60% maximum speed) while the pump is operating with a closed discharge valve. The ratio of speeds should be about 2:1. Power is then measured at these speeds and at 100% maximum speed and corrected for a specific gravity=1.

The shutoff power at any speed can then be determined by a proprietary cubic interpolation method:

The coefficients A-F are calculated as follows:

$$A=(P_{SO_30\%})/(N_{30\%})$$

$$B=(P_{SO_60\%}-P_{SO_30\%})/(N_{60\%}-N_{30\%})$$

$$C=(B-A)/(N_{60\%}-N_{30\%})$$

$$D=(P_{SO_100\%}-P_{SO_60\%})/(N_{100\%}-N_{60\%})$$

$$E=(D-B)/((N_{100\%}-N_{30\%})$$

$$F=(E-C)/(N_{100\%})$$

The shutoff power at any speed is calculated as follows:

$$P_{SO_N\%}=A(N_{ACT})+C(N_{ACT})(N_{ACT}-N_{30\%})+F(N_{ACT})(N_{ACT}-N_{30\%})(N_{ACT}-N_{60\%}),$$

Where:

$P_{SO_30}\%=P_{Meas_30\%}/SG$ is the measured shutoff Power at 30% motor nominal speed corrected to a Specific Gravity=1, $P_{SO_60\%}=P_{Meas_60\%}/SG$ is the measured shutoff Power at 60% motor nominal speed corrected to a Specific Gravity=1, and $P_{SO_100\%}=P_{Meas_100\%}/SG$ is the measured shutoff Power at 100% motor nominal speed corrected to a Specific Gravity=1.

It is noted that for some embodiments, such as for sealless pumps, eddy current loss estimations must be removed from measured closed power values.

It is also noted that to improve accuracy for some embodiments, such as small hp pumps applied on liquids with specific gravity other than 1.0, mechanical losses (such as seals and bearings) can be compensated for in the above shutoff power equations as follows:

$$P_{SO_N}=[(P_{Meas_N\%}-(\text{Mech Loss}\times N_{Act}/N_{Rated}))/SG]+(\text{Mech Loss}\times N_{Act}/N_{Rated}),$$

where

SG=specific Gravity, $N_{30\%}$=Speed at 30% motor nominal speed, $N_{60\%}$=Speed at 60% motor nominal speed, and $N_{100\%}$=Speed at 100% motor nominal speed.

Figure 5:
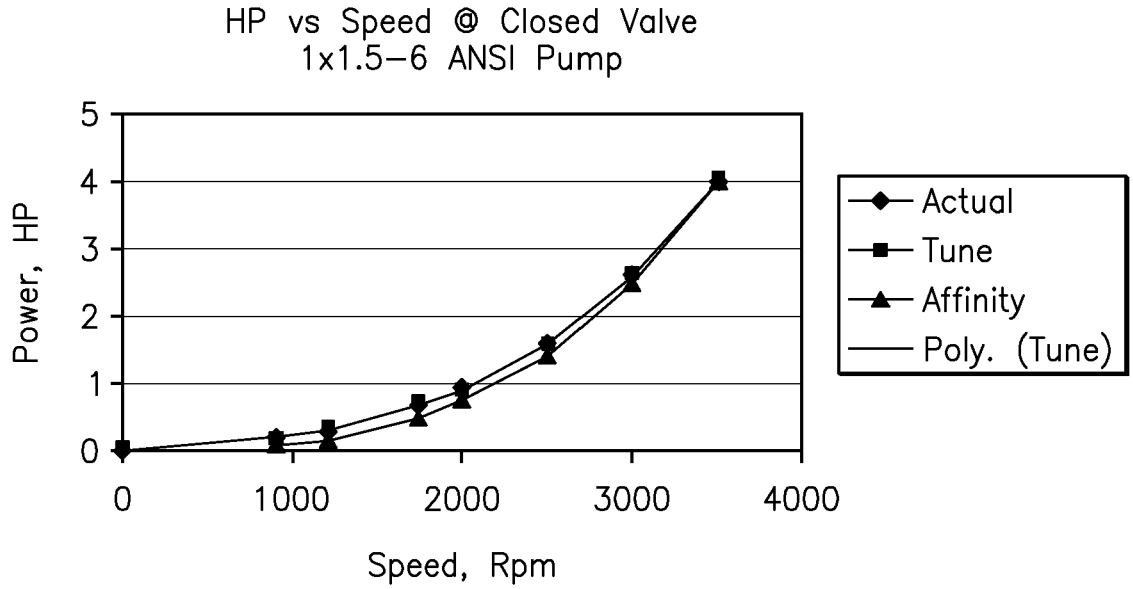
FIG. 5 is a graph of curves for power (HP) versus speed (RPM) @ closed valve condition for actual drive power, tuned power, and affinity methods.

FIG. 5 is a graph that shows how the tuned power vs speed curve compares to the affinity law power correction at closed valve (shutoff) condition vs actual power.

In higher power pumps, it is necessary to limit speed during tuning in order to prevent the pump from overheating. In this case the power at 100% speed can be calculated from:

$$P_{SO_100\%}=(N_{100\%}/N_{60\%})^{KSO}\times P_{SO_60\%},$$

where KSO is a shutoff exponent with a typical value of 3.0.

The final step of the logic according to the present invention is to estimate the Power at the Best Efficiency Point (BEP). This function relies upon the observation that while the actual values of $P_{BEP}$ and $P_{SO}$ on any given pump may vary greatly from the published performance curve, the slope of the power curve remains relatively constant.

$$P_{BEP\ corr}=(P_{SO_{100\%}}-P_{SO})+P_{BEP},$$

Where:

$P_{SO}$=Pump power at shutoff at 100% speed from published curve, and $P_{BEP}$=Pump power at BEP at 100% speed from published curve.

Figure 6:
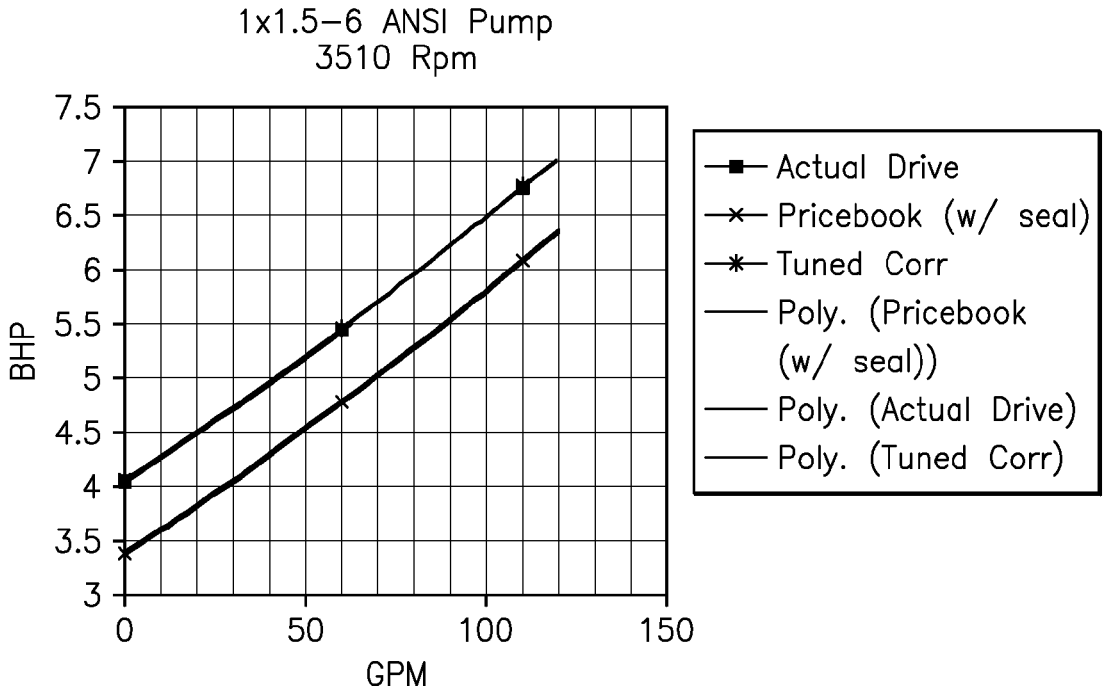
FIG. 6 is a graph of curves for power (BHP) versus flow (GPM) for actual drive power, pricebook (w/seal) published data and tuned power corrected data with polynomial curve fits also shown for each data set.

FIG. 6 is a graph that shows how the tuned power vs flow curve relates to the published pricebook curve. Note the slope of both curves are the same.

Other less accurate approximations can also be made to obtain a factoring coefficient "$K_{SO}$" which can be estimated by taking the ratio of the natural log of the power ratio to the speed ratio, as follows:

$$KSO=LN(P_{so1}/P_{so2})/LN(N_1/N_2),$$

Where:

$P_{so1}$=measured shutoff power at speed $N_1$, and $P_{so2}$=measured shutoff power at speed $N_2$.

The shutoff power at any speed can then be determined by:

$$P_{SO\ xrpm}=P_{SO\ yrpm}\times(N_{xrpm}/N_{yrpm})^{KSO},$$

Where:

$P_{SO\ xrpm}$=shutoff power at speed $N_{xrpm}$, and $P_{SO\ yrpm}$=shutoff power at speed $N_{yrpm}$.

Step B

In order to determine a calculated flow value normalized power curves are calculated based on the Pump's Power Ratio, where:

$$P_{Ratio}=P_{SO_100\%}/P_{BEP\ corr}.$$

The normalization curves are particular to a pump's Power Ratio and specific speed. Specific speed is a numerical value which relates to the hydraulic performance of a centrifugal pump.

Figure 7:
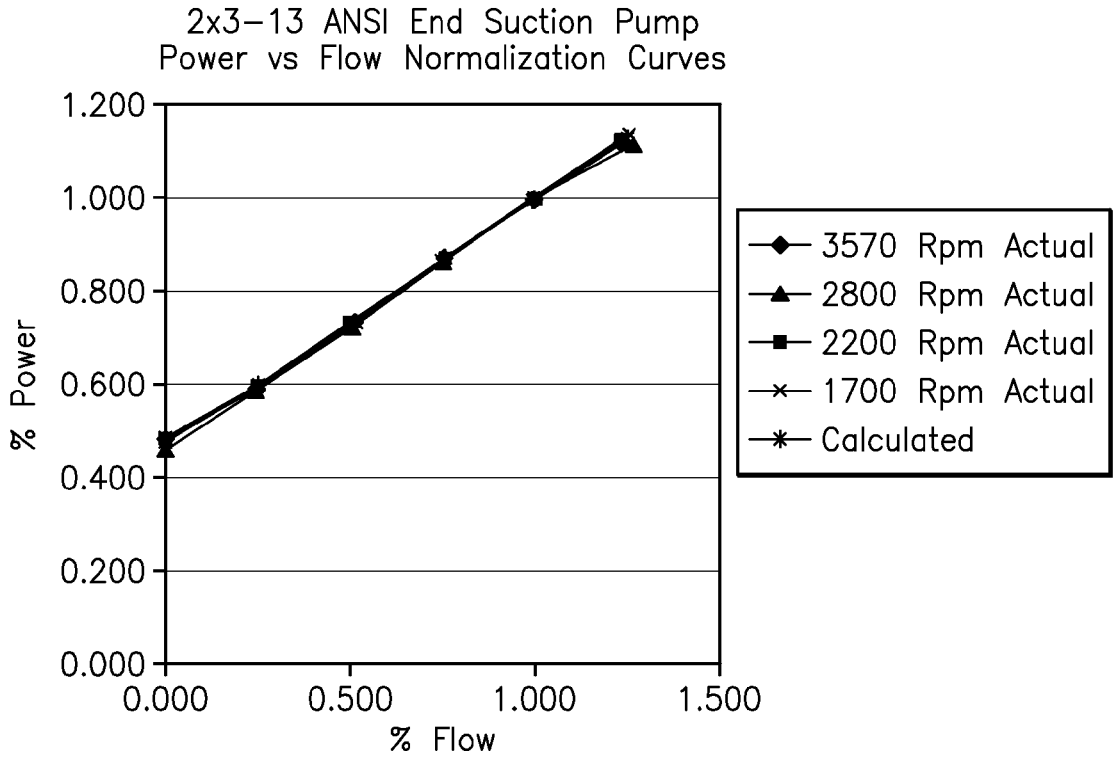
FIG. 7 is a graph of normalized curves for % power (HP) versus % flow (RPM) at 1700, 2200, 2800, 3570 RPMs actual and as calculated.

FIG. 7 is a graph that shows, by way of example, normalization curves plotted for several speeds for a 2×3-13 end suction pump having a $P_{Ratio}$=0.45 and a specific speed of 836.

The table below shows actual vs. normalized test data for flow and power for the 2×3-13 pump at 3570 rpm.

| Flow, Gpm | Normalized Flow | Power, HP | Normalized Power |
|---|---|---|---|
| 0 | 0.00 | 79.8 | 0.45 |
| 188 | 0.24 | 102.7 | 0.58 |
| 398 | 0.51 | 129.2 | 0.73 |
| 590 | 0.76 | 154.5 | 0.87 |
| 775 | 1.00 | 177.2 | 1.00 |
| Bep Flow | | Bep HP | |
| 960 | 1.24 | 198.7 | 1.12 |

A 3$^{rd}$ order polynomial power equation was developed using the coefficients from the normalized power vs flow curve. Corrections are made for speed and hydraulic efficiency in the power equation.

Normalized power vs flow curve coefficients a, b and c define the normalized curve shape, as follows:

$$0=[(P_{BEP\ CORR}(a))/((Q_{BEP})^3(\eta_{HBEP_CORR}))](Q_{Act})^3+[((N_{Act})(P_{BEPCORR})(b))/((N_{Rated})(Q_{BEP})^2(\eta_{HBEP_CORR}))](Q_{Act})^2+[((N_{Act})^2(P_{BEP\ CORR})(c))/((N_{Rated})^2(Q_{BEP})(\eta_{HBEP_CORR}))](Q_{Act})+(P_{SO_N\%}-(P_{ACT}/S.G.)),$$

Where:

$P_{BEP\ CORR}$=corrected pump power at BEP as determined from the tuned power curve at rated speed, $Q_{BEP}$=Pump Flow at BEP at rated speed, $\eta_{HBEP_CORR}$=hydraulic efficiency correction, $\eta_{HBEP}\cong 1-0.8/Q_{BEP}^{0.25}$ published values typically range from 0.7-0.95, $N_{Act}$=actual operating speed, $N_{Rated}$=rated speed, $P_{SO_N\%}$=Pump shutoff power at actual operating speed (determined from tuned power curve), $P_{ACT}$=Actual pump power, S.G.=specific gravity, and $Q_{Act}$=calculated actual flow at current operating speed.

It is noted again that to improve accuracy for some embodiments, such as small hp pumps applied on liquids with specific gravity other than 1.0, mechanical losses (such as seals and bearings) can be compensated for in the above power equation by adjusting $P_{ACT}$ as follows:

$$P_{ACT\ CORR}=[((P_{ACT}-(\text{Mech Loss}\times N_{Act}/N_{Rated}))/S.G.)+(\text{Mech Loss}\times N_{Act}/N_{Rated})].$$

It is also noted again that, for some embodiments such as sealless pumps, eddy current loss estimations must be removed from actual power reading in the above power equation.

Figure 8:
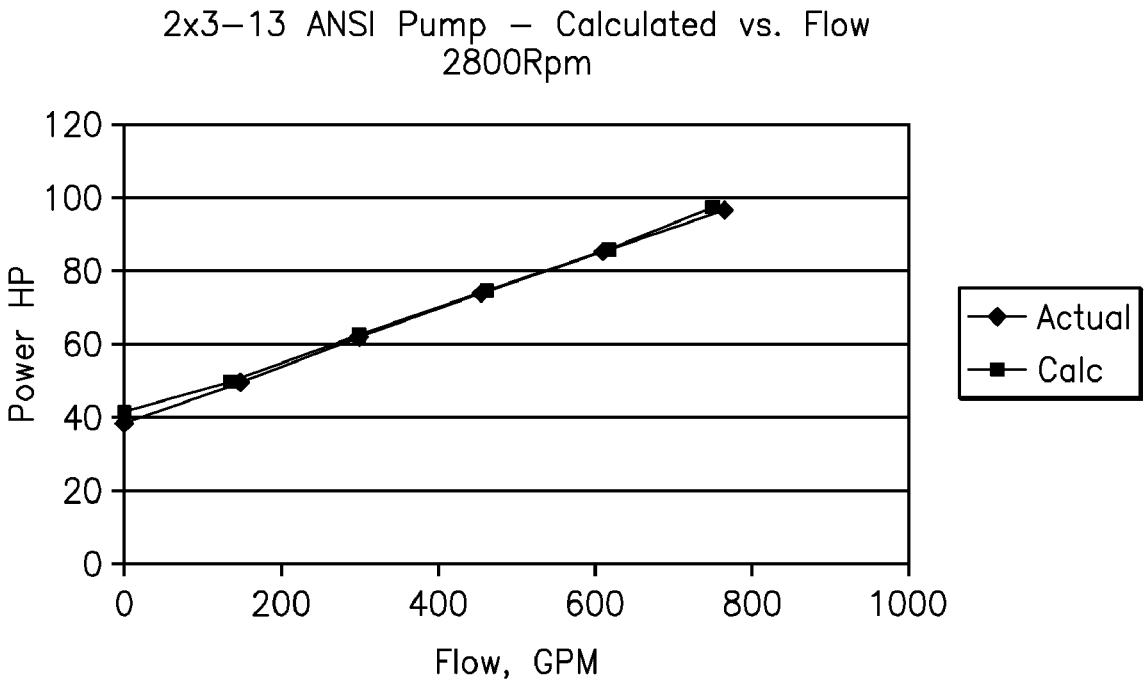
FIG. 8 is a graph of curves for tuned power (BHP) versus flow (GPM) for actual flow and calculated flow.

Complex roots are than determined to solve the 3$^{rd}$ order polynomial using Mullers Method or other equivalent methods. The calculated actual flow is then determined for the specific operating point. FIG. 8 is a graph that shows the calculated power vs flow curve when plotted for the 3$^{rd}$ order polynomial power equation compared to actual flow data obtained by flowmeter readings.

Since pump wear will effect the pump power requirement and therefore reduce flow accuracy the power calculations can be periodically compensated for by periodically performing another calibration as outlined in step A.

Other Possible Applications

Other possible applications include at least the following:

Pump Load Monitors—Pump load monitors rely upon an accurate modeling of the pump power curve to identify minimum flow and shut-off conditions. While most load monitors only monitor power at one speed, this logic would enable more accurate load monitors for variable speed operation.

Sensorless flow calculations—Sensorless flow estimations rely upon accurate power curves to estimate pump flow. The use of basic affinity laws may compromise flow accuracy as speed is decreased. This is especially true on smaller pumps where losses such as seals and bearings become more prominent and do not factor according to the affinity laws.

Pump Protection Algorithms—sensorless flow measurements can give a reliable indication of operating conditions: runout conditions (flow too high), operation below minimum pump flow (flow too low) or operation against a closed discharge valve.

The Scope of the Invention

It should be understood that, unless stated otherwise herein, any of the features, characteristics, alternatives or modifications described regarding a particular embodiment herein may also be applied, used, or incorporated with any other embodiment described herein. Also, the drawings herein are not drawn to scale.

Although the invention has been described and illustrated with respect to exemplary embodiments thereof, the foregoing and various other additions and omissions may be made therein and thereto without departing from the spirit and scope of the present invention.

We claim:

1. A method for determining pump flow in a centrifugal pump, centrifugal mixer, centrifugal blower or centrifugal compressor comprising:

creating a calibrated power curve at closed valve conditions at several speeds by increasing the speed of the pump from a minimum speed to a maximum speed while operating the pump against a closed discharge valve and collecting speed and power data at said several speeds;

calculating coefficients from a power vs flow curve based on a pump's power ratio, wherein the pump's power ratio is the power at shutoff divided by the power at the best efficiency point at maximum speed corrected for the difference between actual and published power at the shutoff condition; and solving a polynomial power equation for flow at the current operating point, which is developed based at least partly on coefficients of the power vs flow curve.

2. A method according to claim 1, wherein dosed valve power data is corrected to a specific gravity equal to 1.

3. A method according to claim 1, wherein the method further compensates measured closed valve power readings for mechanical losses, including losses for seals and bearings, for small hp pumps applied on liquids with specific gravity other than 1.0 based at least partly on a determination of a shutoff power.

4. A method according to claim 1, wherein the method comprises removing eddy current loss estimations from actual closed valve power readings for sealless pumps.

5. A method according to claim 1, wherein the method further comprises minimizing heating of a pumped liquid for higher power pumps based at least partly on a determination of shutoff power at other than 100% speed and calculating power at 100% speed.

6. A method according to claim 1, wherein the method further comprises determining the closed valve power at any speed using a cubic interpolation method based at least partly on a determination of shutoff power that depends on the speed of the pump.

7. A method according to claim 1, wherein the method further comprises determining the pump's power ratio by the equation: $P_{ratio}=P_{SO_{100\%}}/P_{BEP_corr}$, where $$P_{BEP_corr}=(P_{SO_{100\%}}-P_{SO})+P_{BEP},$$

where:

$P_{SO}$=Pump power at shutoff at 100% speed from published curve, $P_{BEP}$=Pump power at BEP at 100% speed from published curve, and $P_{SO_{100\%}}$=actual closed valve power at 100% speed.

8. A method according to claim 1, wherein the method further comprises performing the method on a variable frequency drive (VFD) or a programmable logic controller (PLC).

9. A method according to claim 1, wherein the method further comprises using a determined flow value as an input to a controller including a PID controller, to control flow without the need for a flowmeter or other external instrumentation.

10. A method according to claim 1, wherein the method further comprises correcting the published power at the best efficiency point at rated speed based at least partly on actual closed valve power data.

11. A method according to claim 10, wherein the method further comprises correcting the published power based at least partly on the best efficiency point is corrected according to the equation:

$$P_{BEP\ corr}=(P_{SO_{100\%}}-P_{SO})+P_{BEP},$$

where:

$P_{SO}$=Pump power at shutoff at 100% speed from published curve, $P_{BEP}$=Pump power at BEP at 100% speed from published curve, and $P_{SO_{100\%}}$=actual closed valve power at 100% speed.

12. A method according to claim 1, wherein the polynomial power equation is developed using coefficients from a normalized power vs flow curve.

13. A method according to claim 12, wherein the method further comprises compensating accuracy for small hp pumps applied on liquids with specific gravity other than 1.0 for mechanical losses, including seals and bearings, based at least partly on correcting for the actual power in the polynomial power equation.

14. A method according to claim 12, wherein the method further comprises for sealless pumps removing eddy current loss estimations from an actual power reading in the power equation.

15. A method according to claim 12, wherein the method further comprises making corrections for speed, hydraulic efficiency and specific gravity in the polynomial power equation.

16. A method according to claim 15, wherein the method further comprises determining complex roots to solve the power polynomial equation using either Muller's method or some other suitable method.

17. A method according to claim 16, wherein the method further comprises determining a calculated actual flow for a specific operating point.

18. A controller for determining pump flow in a centrifugal pump, centrifugal mixer, centrifugal blower or centrifugal compressor comprising:

at least one module configured to:

create a calibrated power curve at dosed valve conditions at several speeds by increasing the speed of the pump from a minimum speed to a maximum speed while operating the pump against a closed discharge valve and collecting speed and power data at said several speeds;

calculate coefficients from a power vs flow curve based on a pump's power ratio, wherein the pump's power ratio is the power at shutoff divided by the power at the best efficiency point at maximum speed corrected for the difference between actual and published power at the shutoff condition; and a solve a polynomial power equation for flow at the current operating point, which is developed based at least partly on coefficients of the power vs flow curve.

19. A controller according to claim 18, wherein the at least one module is configured to correct closed valve power data to a specific gravity equal to 1.

20. A controller according to claim 18, wherein the at least one module is configured to compensate measured closed valve power readings for mechanical losses, including losses for seals and bearings, for small hp pumps applied on liquids with specific gravity other than 1.0, based at least partly on a determination of shutoff power.

21. A controller according to claim 18, wherein the at least one module is configured to remove eddy current loss estimations from actual closed valve power readings for sealless pumps.

22. A controller according to claim 18, wherein the at least one module is configured to minimize heating of a pumped liquid for higher power pumps based at least partly on a determination of the shutoff power at other than 100% speed and calculating power at 100% speed.

23. A controller according to claim 18, wherein the at least one module is configured to determine the closed valve power at any speed using a cubic interpolation method based at least partly on a determination of shutoff power that depends on the speed of the pump.

24. A controller according to claim 18, wherein the at least one module is configured to determine the pump's power ratio is determined by the equation:

$$P_{ratio}=P_{SO_{100\%}}/P_{BEP_corr},$$

where:

$$P_{BEP_corr}=(P_{SO_{100\%}}-P_{SO})+P_{BEP},$$

where:

$P_{SO}$=Pump power at shutoff at 100% speed from published curve, $P_{BEP}$=Pump power at BEP at 100% speed from published curve, and $P_{SO_{100\%}}$=actual closed valve power at 100% speed.

25. A controller according to claim 18, wherein the controller includes, or forms part of, a variable frequency drive (VFD) or a programmable logic controller (PLC).

26. A controller according to claim 18, wherein the one or more modules is configured to use a determined flow value as an input to a controller, includinga PID controller, to control flow without the need for a flowmeter or other external instrumentation.

27. A controller according to claim 18, wherein the at least one module is configured to correct the published power at the best efficiency point at rated speed based at least partly on actual closed valve power data.

28. A controller according to claim 27, wherein at least one module is configured to correct the published power based at least partly on the best efficiency point is corrected according to the equation:

$$P_{BEP\ corr}=(P_{SO_{100\%}}-P_{SO})+P_{BEP},$$

where:

$P_{SO}$=Pump power at shutoff at 100% speed from published curve, $P_{BEP}$=Pump power at BEP at 100% speed from published curve, and $P_{SO_{100\%}}$=actual closed valve power at 100% speed.

29. A controller according to claim 18, wherein the power equation is a polynomial power equation developed using coefficients from a normalized power vs flow curve.

30. A controller according to claim 29, wherein the at least one module is configured to compensate accuracy for small hp pumps applied on liquids with specific gravity other than 1.0 for mechanical losses, including such as seals and bearings, based at least partly on correcting for the actual power in the polynomial power equation.

31. A controller according to claim 29, wherein the at least one module is configured to remove for sealless pumps eddy current loss estimations from an actual power reading in the power equation.

32. A controller according to claim 29, wherein the at least one module is configured to make corrections for speed, hydraulic efficiency and specific gravity in the polynomial power equation.

33. A controller according to claim 32, wherein the at least one module is configured to determine complex roots to solve the polynomial equation using either Muller's method or some other suitable method.

34. A controller according to claim 33, wherein the at least one module is configured to determine a calculated actual flow for a specific operating point.

35. A system having a controller for determining pump flow in a centrifugal pump, centrifugal mixer, centrifugal blower or centrifugal compressor, the controller comprising:

at least one module configured to create a calibrated power curve at dosed valve conditions at several speeds by increasing the speed of the pump from a minimum speed to a maximum speed while operating the pump against a dosed discharge valve and collecting speed and power data at said several speeds;

calculate coefficients from a power vs flow curve based on a pump's power ratio, wherein the pump's power ratio is the power at shutoff divided by the power at the best efficiency point at maximum speed corrected for the difference between actual and published power at the shutoff condition; and solve a polynomial power equation for flow at the current operating point, which is developed based at least partly on coefficients of the power vs flow curve.

36. A pump system according to claim 35, wherein the at least one module is configured to correct closed valve power data to a specific gravity equal to 1.

37. A pump system according to claim 35, wherein the at least one module is configured to compensate measured closed valve power readings for mechanical losses, including losses for seals and bearings, for small hp pumps applied on liquids with specific gravity other than 1.0, based at least partly on a determination of shutoff power.

38. A pump system according to claim 35, wherein the at least one module is configured to remove eddy current loss estimations from actual closed valve power readings for sealless pumps.

39. A pump system according to claim 35, wherein the at least one module is configured to minimize heating of a pumped liquid for higher power pumps based at least partly on a determination of shutoff power at other than 100% speed and calculating power at 100% power.

40. A pump system according to claim 35, wherein the at least one module is configured to determine the closed valve power at any speed using a cubic interpolation method based at least partly on a determination of shutoff power that depends on the speed of the pump.

41. A pump system according to claim 35, wherein the at least one module is configured to determine the pump's power ratio is determined by the equation:

$$P_{ratio}=P_{SO_{100\%}}/P_{BEP_corr},$$

where:

$$P_{BEP_corr}=(P_{SO_{100\%}}-P_{SO})+P_{BEP},$$

$P_{SO}$=Pump power at shutoff at 100% speed from published curve, $P_{BEP}$=Pump power at BEP at 100% speed from published curve, and $P_{SO_{100\%}}$=actual closed valve power at 100% speed.

42. A pump system according to claim 35, wherein the controller includes, or forms part of, a variable frequency drive (VFD) or a programmable logic controller (PLC).

43. A pump system according to claim 35, wherein the at least one module or is configured to use a determined flow value as an input to a controller, including a PID controller, to control flow without the need for a flowmeter or other external instrumentation.

44. A pump system according to claim 35, wherein the at least one module is configured to correct the published power at the best efficiency point at rated speed based at least partly on actual closed valve power data.

45. A pump system according to claim 44, wherein the at least one module is configured to correct the published power based at least partly on a best efficiency point is corrected according to the equation:

$$P_{BEP\ corr}=(P_{SO_{100\%}}-P_{SO})+P_{BEP},$$

where:

$P_{SO}$=Pump power at shutoff at 100% speed from published curve, $P_{BEP}$=Pump power at BEP at 100% speed from published curve, and $P_{SO_{100\%}}$=actual closed valve power at 100% speed.

46. A pump system according to claim 35, wherein the polynomial power equation is developed using coefficients from a normalized power vs flow curve.

47. A pump system according to claim 46, wherein the at least one module is configured to compensate accuracy for small hp pumps applied on liquids with specific gravity other than 1.0 for mechanical losses, including such as seals and bearings, based at least partly on correcting for the actual power in the polynomial power equation.

48. A pump system according to claim 46, wherein the at least one module is configured to remove for sealless pumps eddy current loss estimations from an actual power reading in the polynomial power equation.

49. A pump system according to claim 46, wherein the at least one module is configured to make corrections for speed, hydraulic efficiency and specific gravity in the power equation.

50. A pump system according to claim 49, wherein the at least one module is configured to determine complex roots to solve the polynomial power equation using either Muller's method or some other suitable method.

51. A pump system according to claim 50, wherein the at least one module is configured to determine a calculated actual flow for a specific operating point.

* * * * *

UNITED STATES PATENT AND TRADEMARK OFFICE

CERTIFICATE OF CORRECTION

PATENT NO. : 7,945,411 B2
APPLICATION NO. : 11/636355
DATED : May 17, 2011
INVENTOR(S) : Daniel J. Kernan et al.

It is certified that error appears in the above-identified patent and that said Letters Patent is hereby corrected as shown below:

In column 9 line 19 (claim 2, line 1), “dosed” should be --closed--.
In column 9 line 45 (claim 7, line 6), “where:” should be deleted.
In column 11 line 16 (claim 24, line 7), “where:” should be deleted.
In column 12 line 64 (claim 43, line 2), “or” should be deleted.

Signed and Sealed this
Thirty-first Day of January, 2012

David J. Kappos

David J. Kappos
*Director of the United States Patent and Trademark Office*